US006010356A

United States Patent [19]

Hale et al.

[11] Patent Number: 6,010,356

[45] Date of Patent: Jan. 4, 2000

[54] QUICK WIRE ELECTRICAL SOCKET WITH STRAIN RELIEF

[75] Inventors: Scot J. Hale, Williston Park; James N. Pearse, Dix Hills; Dennis A. Oddsen, Eatons Neck; Anthony Tufano, North Massapequa, all of N.Y.

[73] Assignee: Leviton Manufacturing Co., Inc., Little Neck, N.Y.

[21] Appl. No.: 09/196,652

[22] Filed: Nov. 19, 1998

[51] Int. Cl.[7] ..... F21J 21/00

[52] U.S. Cl. ..... 439/459; 439/419

[58] Field of Search ..... 439/456–459, 439/419

[56] References Cited

U.S. PATENT DOCUMENTS

| | | | |
|---|---|---|---|
| 4,759,723 | 7/1988 | Siemon | 439/409 |
| 4,874,329 | 10/1989 | Yu | 439/409 |
| 5,051,877 | 9/1991 | Liao | 439/419 |
| 5,121,310 | 6/1992 | Ahroni | 439/419 |
| 5,552,348 | 9/1996 | Wu | 439/419 |
| 5,779,497 | 7/1998 | Hale et al. | 439/419 |

*Primary Examiner*—Gary F. Paumen
*Attorney, Agent, or Firm*—Paul J. Sutton

[57] ABSTRACT

A quick wired lamp socket assembly which employs a pivoting actuator lever to cause the engagement between an electric cord inserted therein and assembly contacts and provides strain relief to such cord. The actuator lever has a partial top member, an edge of which defines an exposed edge with two conductor recesses and a tooth thereon. The recesses receive the conductors of the cord and the tooth engages the web between the two conductors. The cord is retained against the exposed edge by the circuitous path the cord follows through the lamp socket assembly.

14 Claims, 13 Drawing Sheets

QUICK WIRE ELECTRICAL SOCKET WITH STRAIN RELIEF

BACKGROUND OF THE INVENTION

1. Field of the Invention

The invention pertains to electrical sockets for use with light bulbs and more particularly to sockets which do not require the use of terminal screws with the bared ends of conductors but use insulation piercing contacts, operated by a latch mechanism, to pierce the insulation and make electrical contact with the central metallic conductors within and provide strain relief for electrical cords exiting the caps of a socket assemblies, containing sockets in metal shells with caps thereon, along a central longitudinal axis of the assembly.

2. Description of the Prior Art

Lamp cord or so called "ZIP" cord having two side-by-side electrical conductors, each individually insulated and joined to one another by a web is commonly used for wiring electrical devices, for extension cords and similar devices. Prior art devices such as U.S. Pat. No. 5,779,497 issued Jul. 14, 1998 and assigned to the assignee of the instant invention, provides a strain relief for electrical cords exiting the device and extending in a direction perpendicular to the longitudinal axis of the lamp socket assembly. The strain relief can also be used for electrical cords that extend from the lamp socket assembly along the longitudinal axis. However, the electrical cord must extend along an exterior surface of the lamp socket assembly and thus prevents the use of close fitting metal shells and caps commonly used with lamps and the like. The prior art does not show how to wire an electrical lamp socket with an electrical cord extending along a central longitudinal axis of the lamp socket assembly while providing strain relief for such electrical cord.

SUMMARY OF THE INVENTION

The instant invention overcomes the deficiencies noted above with respect to the prior art by providing a quick wired electrical lamp socket assembly having an actuator means with a partial top member which permits the electrical cord to exit the lamp socket assembly along a central longitudinal axis of the lamp socket assembly without extending along any exterior surface of such assembly. The partial top member presents an exposed edge to engage the exiting electrical cord. The exposed edge is formed with two semi-circular recesses one for each electrical conductor of the two side-by-side insulated conductors which make up the electrical cord. The electrical conductors are received in their respective semi-circular recesses. The exposed edge further includes a tooth located between the two semi-circular recesses to engage the web between the two electrical conductors of the electrical cord. The leading edges of the two semi-circular recesses may be tapered to provide a line of contact between the recesses and the conductors. It is an object of the instant invention to provide an improved electrical lamp socket assembly.

It is an object of the instant invention to provide an electrical lamp socket assembly which permits the electrical cord of the lamp socket assembly to exit the assembly along a central longitudinal axis and does not extend along an exterior surface of said assembly.

It is another object of the instant invention to provide an electrical lamp socket assembly which permits the electrical cord of the lamp socket assembly to exit the assembly along a central longitudinal axis and does not extend along an exterior surface of said assembly and provides strain relief to such electrical cord.

Other objects and features of the invention will be pointed out in the following description and claims and illustrated in the accompanying drawings, which disclose, by way of example, the principles of the invention and the best mode which is presently contemplated for carrying them out.

BRIEF DESCRIPTION OF THE DRAWING

In the drawings in which similar elements are given similar reference characters.

DESCRIPTION OF THE PREFERRED EMBODIMENT

Figure 1:
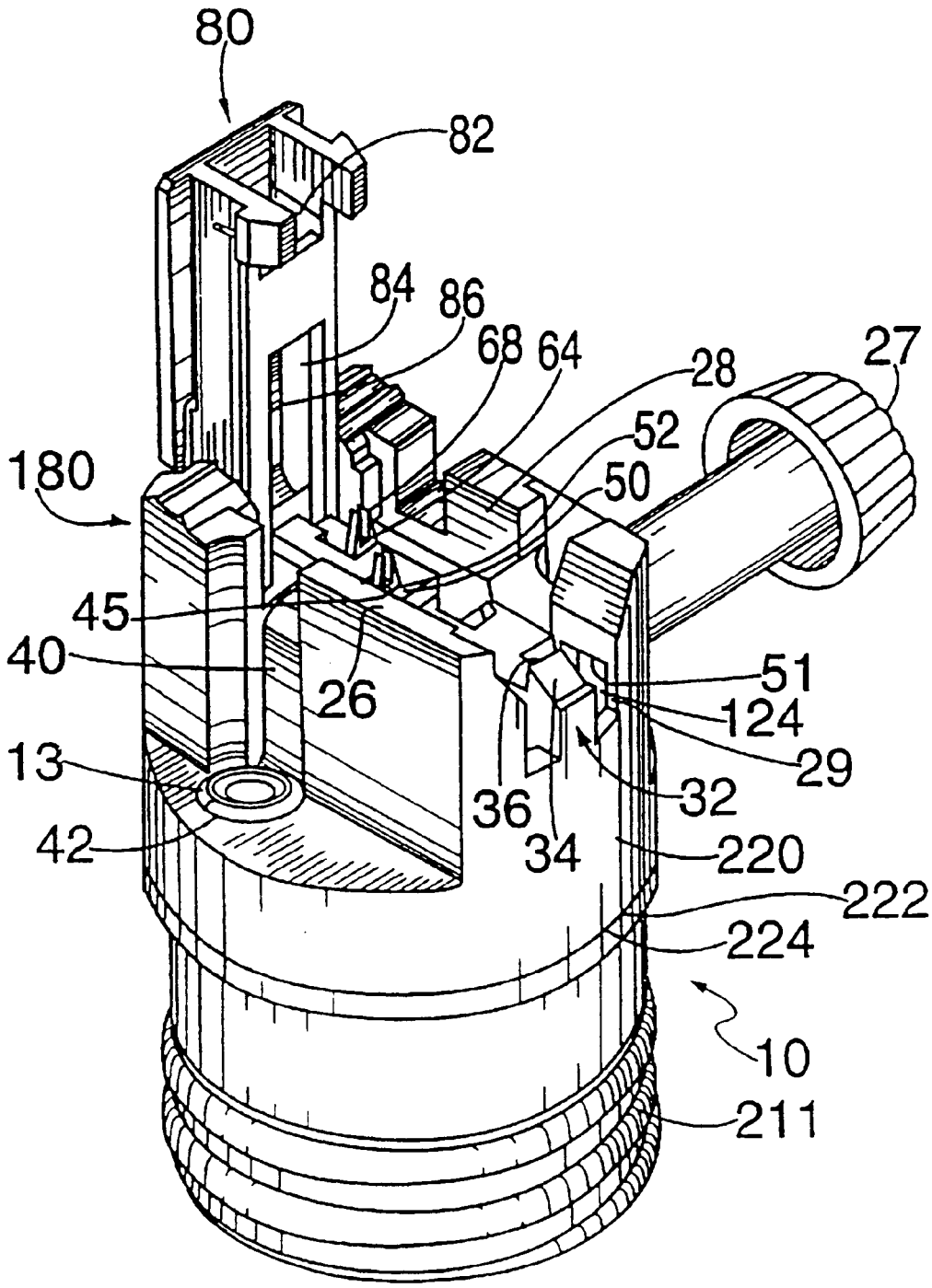
FIG. 1 PRIOR ART
FIG. 1 is a front perspective view of a prior art device and is FIG. 2 of the above-identified U.S. Pat. No. 5,779,497.

Turning now to FIG. 1 there is shown a quick wired electrical lamp socket 10 composed of a non-conductive body 220, an insulating plate or disk 222 and a screwshell 211 held together by a rivet 13. Body 220 has a recess 28 which extends inwardly from the upper surface 26 of body 220 and extends across the entire width of body 220. A tongue 45 to engage one of the conductors of the electrical cord (not shown) extends into the recess 28. A second tongue 64 also extends into recess 28 to engage the second of the two conductors of the electrical cord. An actuating lever 80 is pivotally mounted to the vertical walls of recess 28 at a second end so that the actuating lever 80 first end can be moved towards or away from the floor of recess 28. An electrical cord is inserted through entrance 82 into chamber 86 of the activating lever 80. The lever 80 is then rotated in a clockwise direction towards the floor of the recess bringing the conductors of the electrical cord into engagement with the tongues 45 and 64 making electrical contact between the central metal conductors and the tongues 45 and 64. A strain relief is provided for the electrical cord in the recess 28 by means of an upstanding member 32 which stands in the recess 28 at the opposite end to that where the lever 80 is pivotally mounted. The upstanding member 32 is opposite a cut-out 98 in the bottom wall 96 of activating lever 80 and forces the electrical cord into the cut-out 98 and against the inner surface of top wall 92 as well as against the edges of cut-out 98 providing a grip on the electrical cord to provide strain relief and prevent injury to the joint between the electrical cord and tongues 45 and 64. To use this lamp socket assembly 10 in a lamp where the electrical cord must exit the assembly along the central longitudinal axis would require the electrical cord to be brought around the open end and over the lever 80 which would not permit a shell and cap to be placed over the lamp socket assembly.

Figure 2:
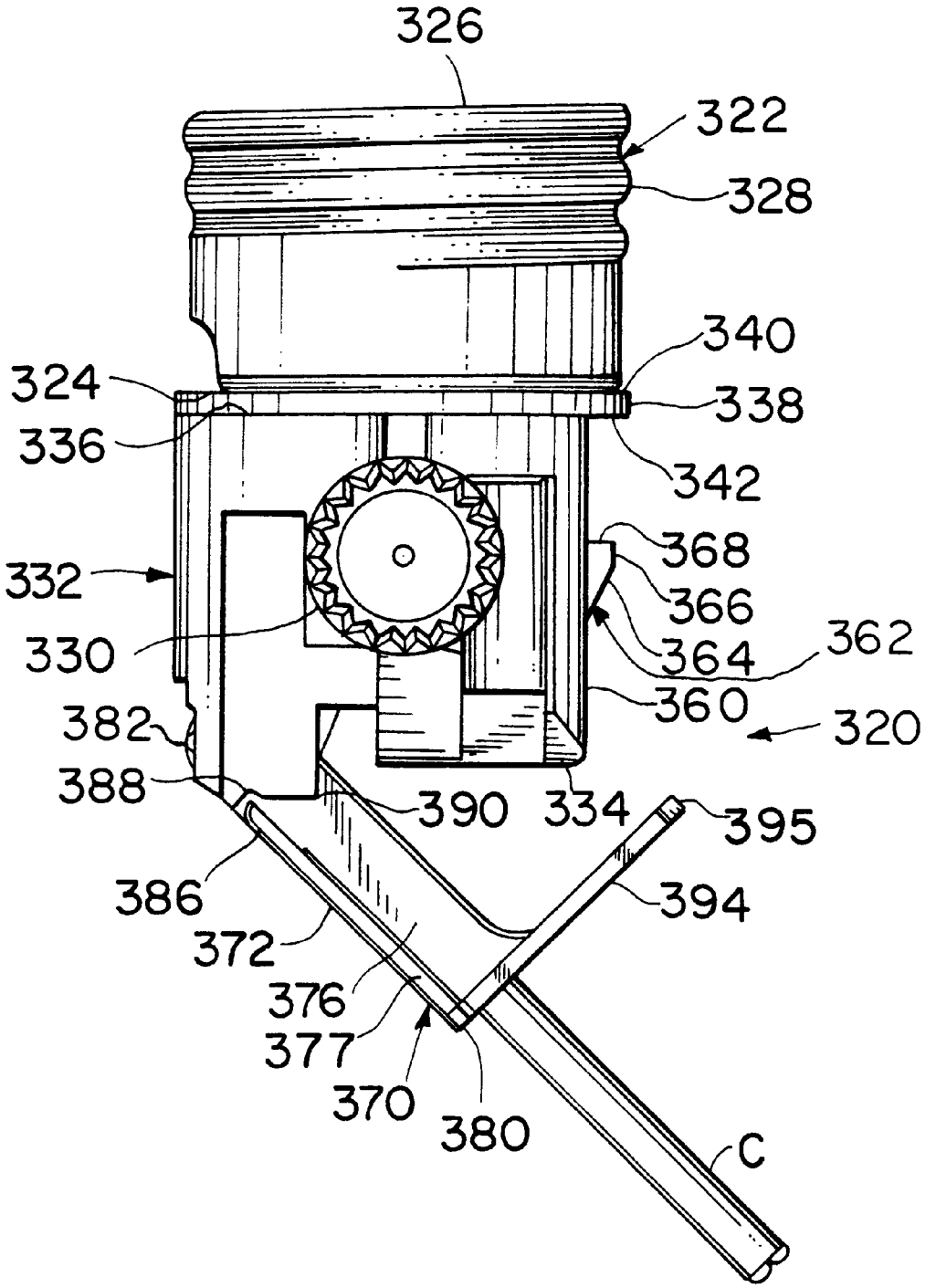
FIG. 2 is a side elevational view of a lamp socket assembly according to the concepts of the invention with the actuator means in the open position and a length of electrical cord inserted therein.
Figure 3:
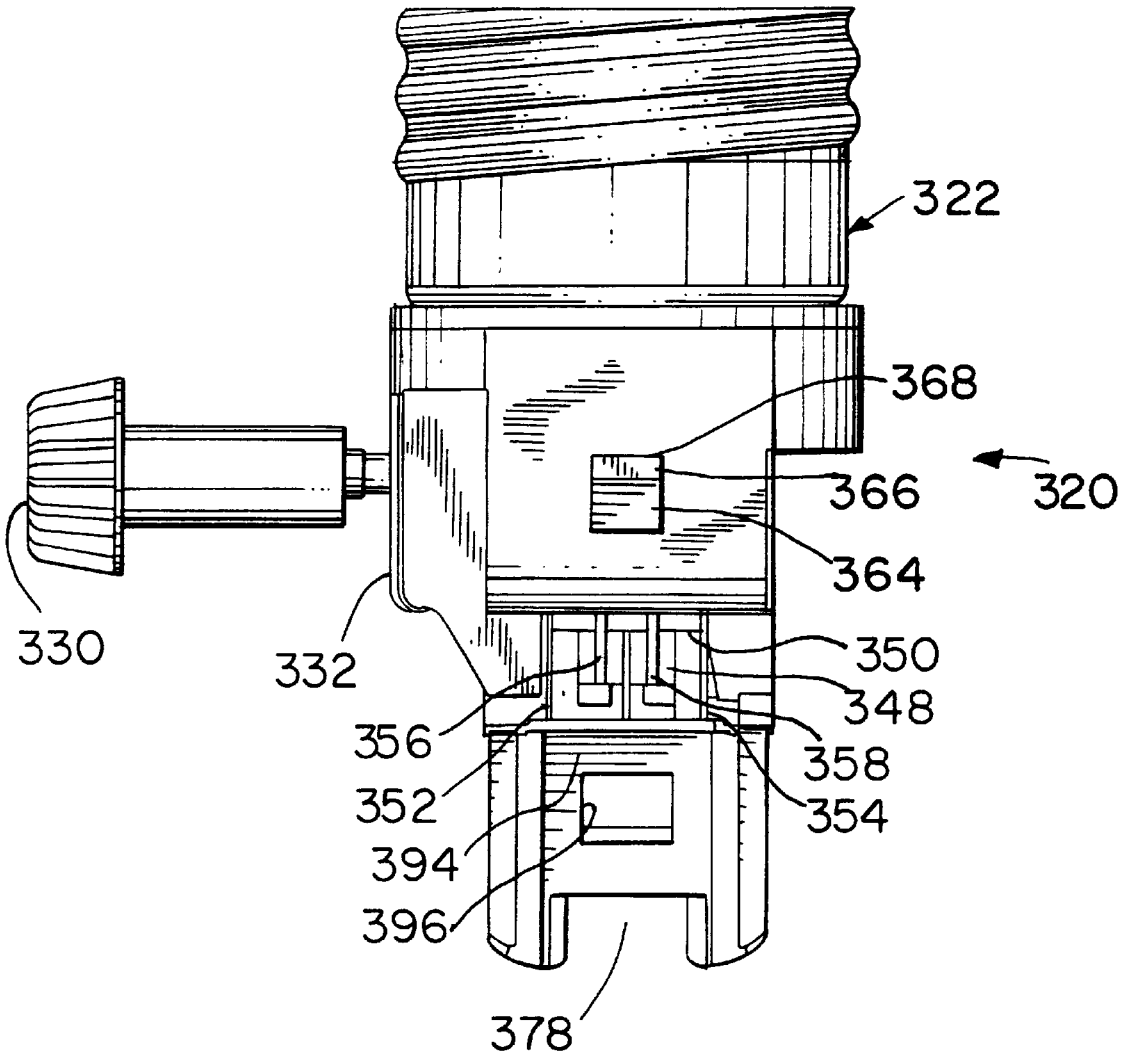
FIG. 3 is a front elevational view of the lamp socket assembly of FIG. 2.

Turning now to FIG. 2 there is shown a lamp socket assembly 320 constructed in accordance with the concepts of the invention. A screwshell 322 has a substantially closed end 324 and an open end 326 with a threaded portion 328 therebetween. The threaded portion 328 is dimensional to receive the threaded base of a standard lamp. The threaded portion 328 will be connected to one line of an AC power source as is well known in the art. Within the screwshell 322 is a contact (not shown) to engage the central button contact of an inserted lamp and will be connected via a switch (not shown) to the other line of the AC power source. The switch will be operated by a key 330. Lamp socket assembly 320 further comprises a body member 332 having a first end surface 334 and a second end surface 336. The body member 332 is fabricated from non-conductive material such as plastic, rubber, EPDM or the like. Between body member 332 and screwshell 322 is an insulating disc 338 having a first surface 340 in contact with substantially closed end 324 of screwshell 322 and a second surface 342 in contact with the second end surface 336 of body member 332. The insulating disc may be made of phenolic, plastic or rubber or the like. The body member 332, the disc 338 and the screwshell 322 are held in assembly by rivets (not shown) as is well known. The rivets also connect the screwshell 322 to one of the AC power lines (not shown) and connect the switch to a second contact of the assembly and to the other AC power line. Formed in the center of first end surface 334 is a recess 348, best seen in FIG. 3. The recess 348 goes across the diameter of the body member 332 first end surface 334 and is half as wide as the diameter of first end surface 334, leaving a shoulder to each side of the recess 348. The recess 348 is defined by floor 350 and vertical walls 352 and 354. A first contact 356 extends through the recess 348, floor 350 to engage one of the conductors of the electrical cord. The contacts have a top surface which is triangular, coming to a point which pierces the insulation about the central metallic conductor, stretches it and makes contact with the central metallic conductor to complete an electric path. A second contact 358 also extends through floor 350 of recess 348 to engage the second conductor of the electrical cord. A complete electrical circuit will be completed through contacts 356, 358 and the conductors of the electric cord when the switch (not shown) is in the closed or "on" position. Body member 332 has a flat front face 360 on which is located a locking step 362. Locking step 362 has an inclined front surface 364, a planar front surface 366, parallel with the central longitudinal axis of the lamp socket assembly 320 and a locking surface 368 perpendicular to the central longitudinal axis of the assembly 320.

Figure 4:
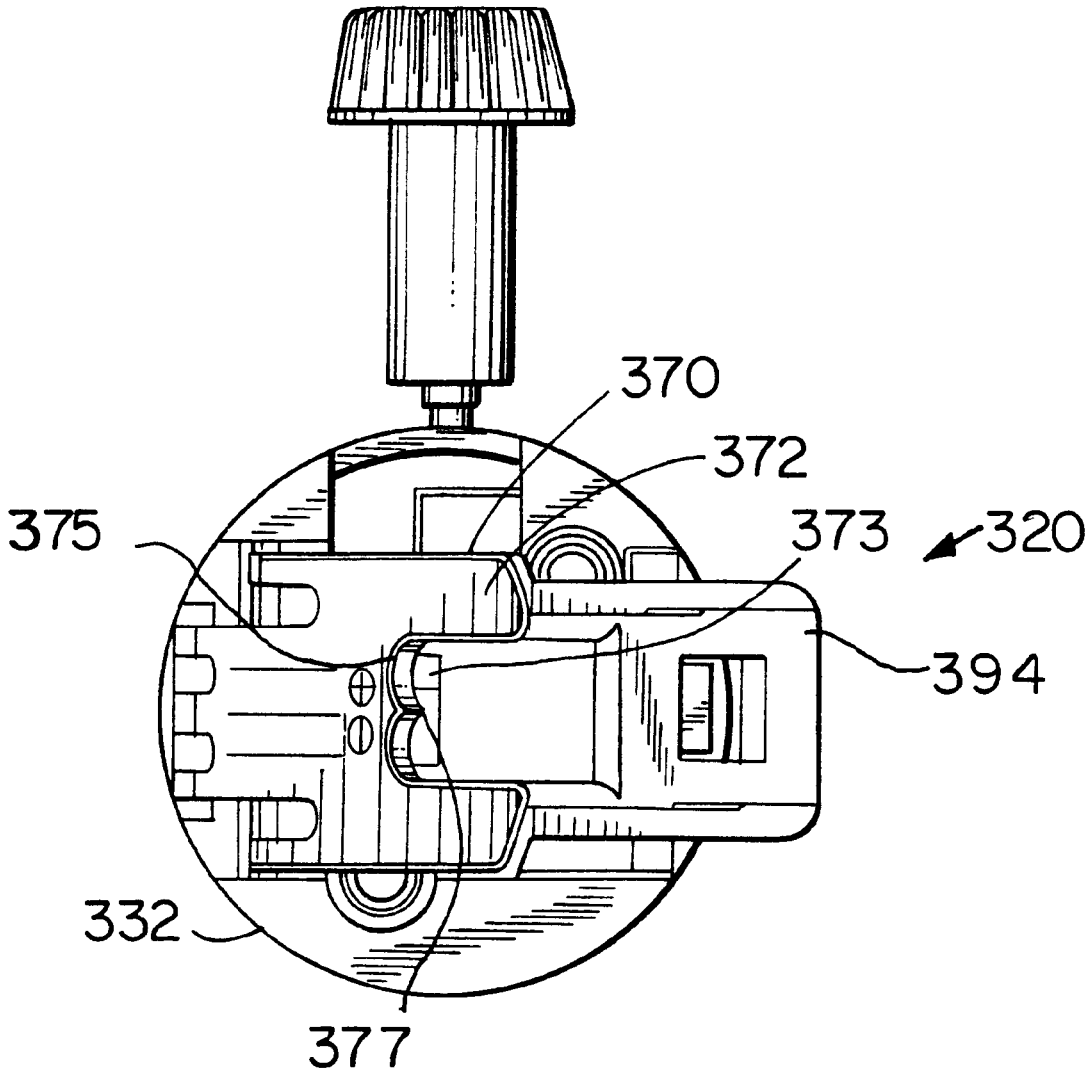
FIG. 4 is a bottom plan view of the lamp socket assembly of FIG. 2.
Figure 5:
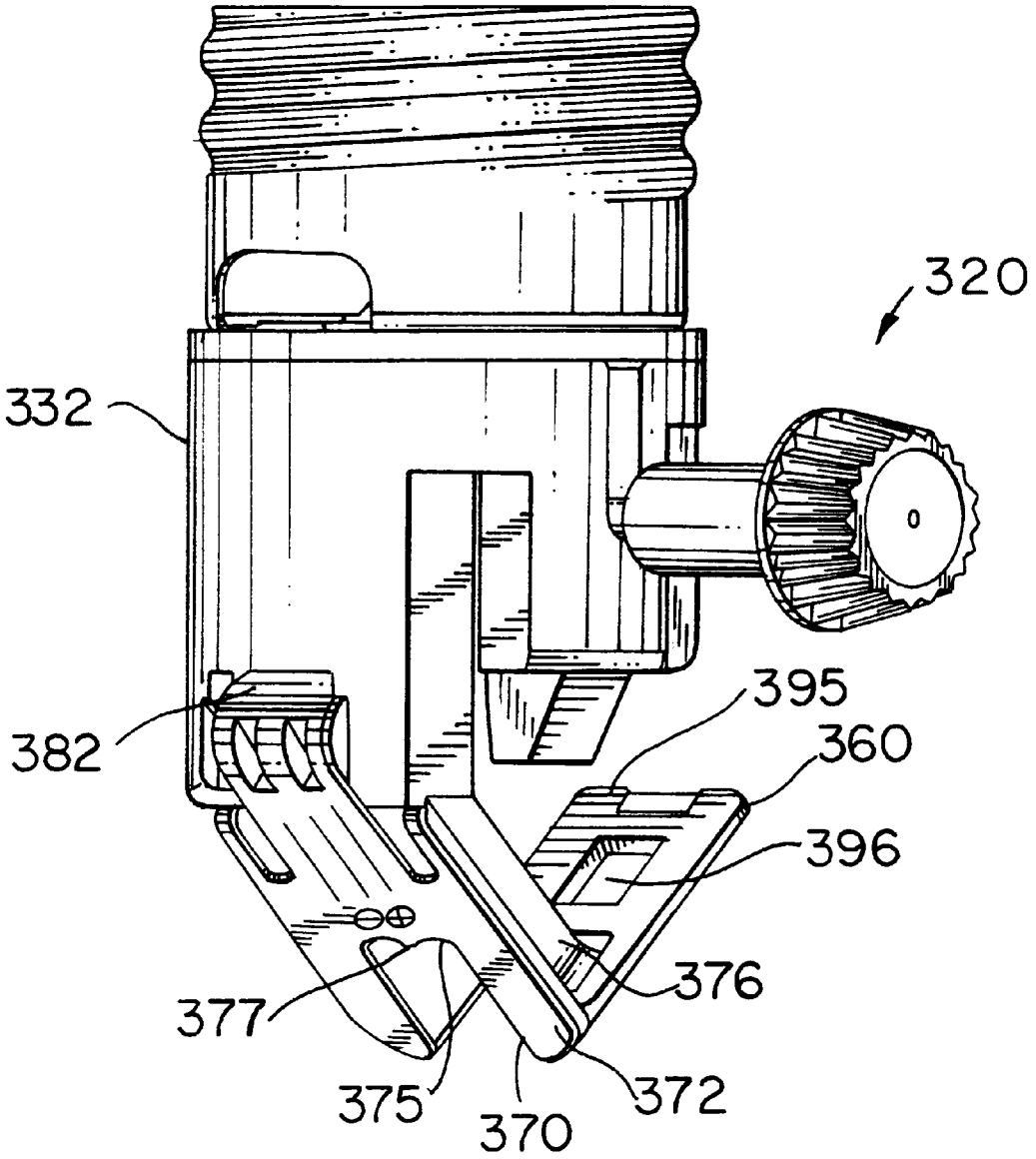
FIG. 5 is a rear perspective view of the lamp socket assembly of FIG. 2.
Figure 11:
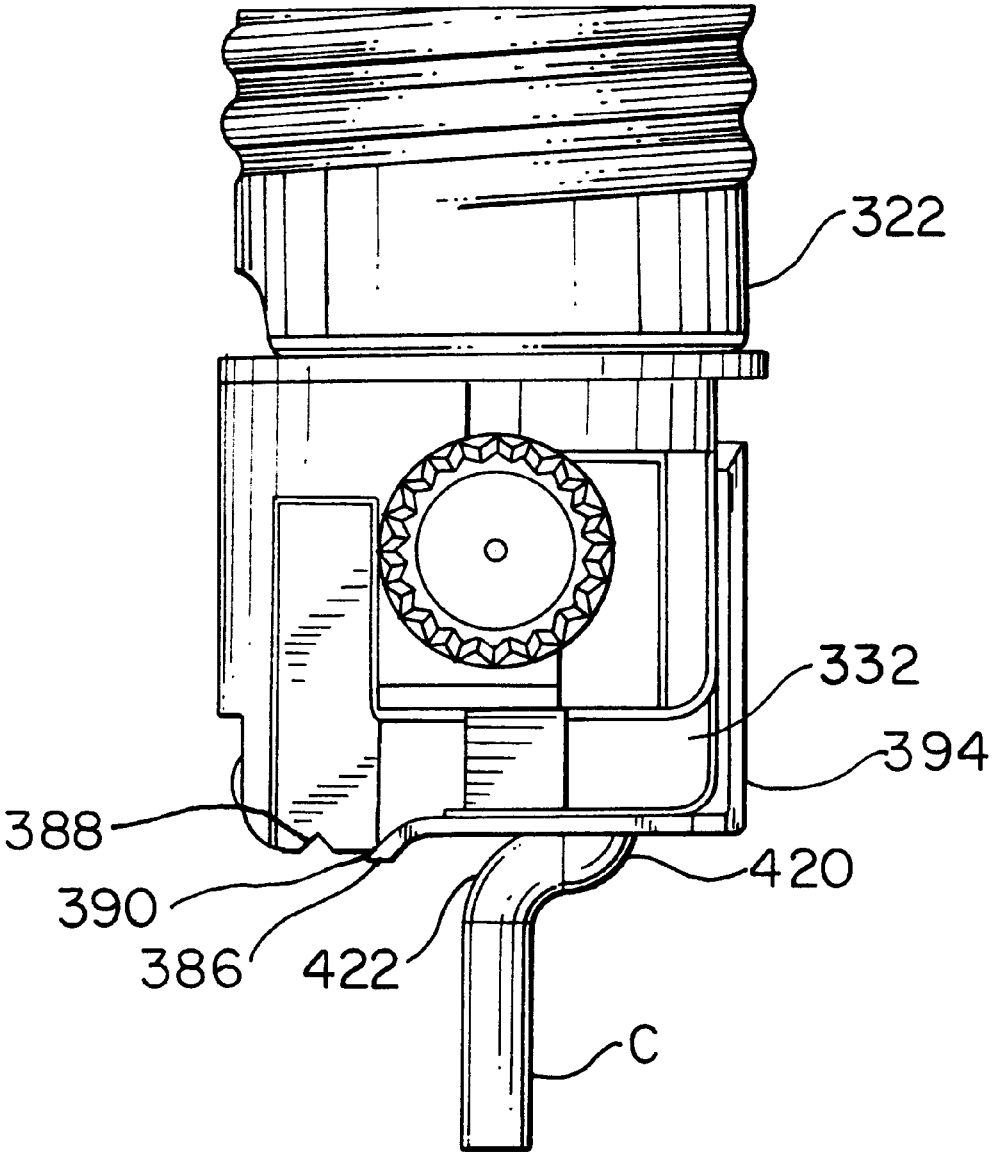
FIG. 11 is a side elevational view of the lamp socket assembly of FIG. 2 closed upon the inserted electrical cord.
Figure 12:
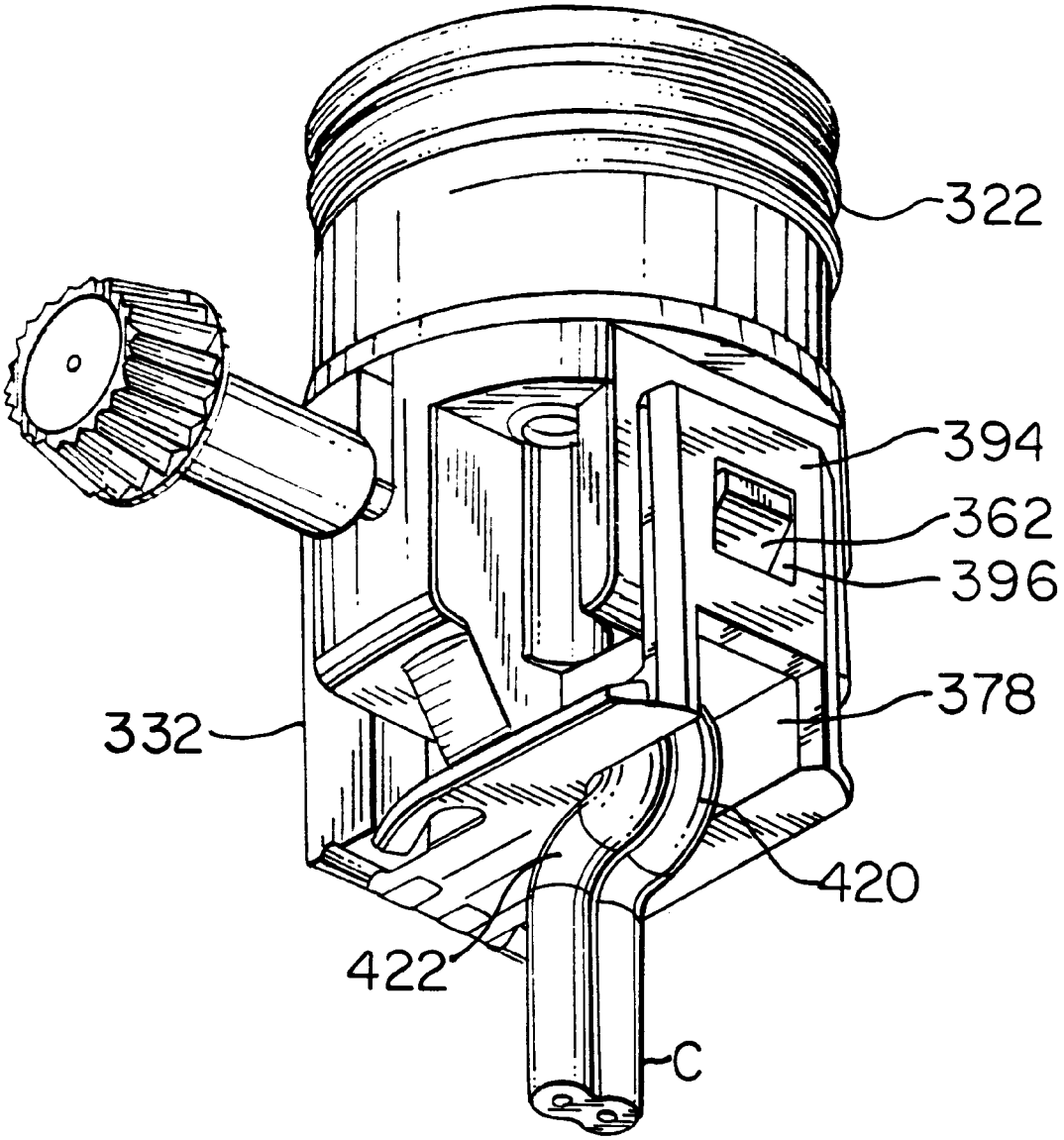
FIG. 12 is a front perspective view of the lamp socket assembly of FIG. 8 closed upon the inserted electrical cord.

Actuator means or lever 370 is shown in FIG. 2 in its open position, that is, to receive an electrical cord C therein. Actuator means 370 has a partial top member 372 (best seen in FIG. 4) which ends in an exposed edge 373. The top member 372 ends in two fingers 386 which engage notches 388 to prevent the separation of the actuator means 370 from the body member 332 by rotating it in a clockwise direction as appears in FIG. 2. The actuator means 370 has two side members 376 and is open at bottom surface. The top member 372 and the side members 376 define a passageway 378 best seen in FIG. 8. When in the position shown in FIGS. 2 and 8 a two side-by-side conductor electrical cord C can be inserted into passageway 378 or removed therefrom. The actuator means 370 can then be rotated in a counter-clockwise direction, as shown in FIG. 2, to bring the open end 380 of actuator means 370 adjacent the floor 350 of recess 348. This action permits the contacts 356, 358 to make electrical contact with the central metallic conductors of the electrical cord C each contact 356, 358 entering a different conductor of the electrical cord C. To remove the electrical cord C from the contacts 356, 358 to replace the electrical cord C or change the lamp socket assembly 320, the actuating means 370 is rotated in a clockwise direction as viewed in FIG. 2 and the electrical cord C can be removed from the electrical contacts 356, 358. The top member 372 is wider than the spacing between the side members 376 to provide ledges 377 which engage the tops of vertical walls 352, 354 and limit the movement of actuator means 370 towards floor 350 of recess 348 to prevent severing of the conductors of electrical cord C. The end 382 of actuator means 370 remote from open end 380 is closed and rounded (see FIG. 5) to prevent engagement between open end 380 and the floor 350 of recess 348 as the actuator means 370 moves towards and away from floor 350. Pivot pins (not shown) on each side member 376 adjacent end 382 engage recesses (not shown) in the interior of the vertical walls 352, 354 to permit actuator 370 to be pivoted towards and away from floor 350. A shoulder 390, on vertical walls 352, 354 (only one is shown in FIG. 2) deflects the fingers 386 when the actuator means 370 is in its closed position as shown in FIG. 11.

A locking plate 394 extends at a right angle to the plane of partial top member 372. The locking plate 394 contains a first aperture 396, best seen in FIG. 3, to receive therein the locking step 362 and locking plate 394 terminates in an edge 395. To lock the actuator means 370 in place and hold the electrical cord C in engagement with the contacts 356 and 358, the locking plate 394 aperture 396 must be made to contain the locking step 362. This is done as follows. The edge 395 is made to trace along the flat front face 360 and over the inclined front surface 364 of the locking step 362. Because of the flexibility of locking plate 394, the locking plate 394 is deflected outwardly away from flat front face 360 until the locking step 362 is fully within aperture 396 at which time the locking plate 392 returns to a position in contact with flat front face 360. To unlock the locking plate 394, the edge 395 is separated from flat front face 360 until the locking step 362 is free of the first aperture 396. The actuator means 370 can now be rotated away from the floor 350 of recess 348.

Partial top member 372 extends from closed end 382 of actuator means 370 to a point approximately half of the length of side members 376 and is terminated in an exposed edge 373. The exposed edge 373 (see FIG. 4) is made up of two generally curved walled recesses 375 separated by a tooth 377. The recesses 375 are dimensional to each receive one of the two conductors of the electrical cord C. The tooth 377 engages the web between the two side-by-side insulated conductors of electrical cord C. The surfaces defining the recesses 375 may be tapered to provide a sharp line of engagement with the conductors of electrical cord C.

Figure 6:
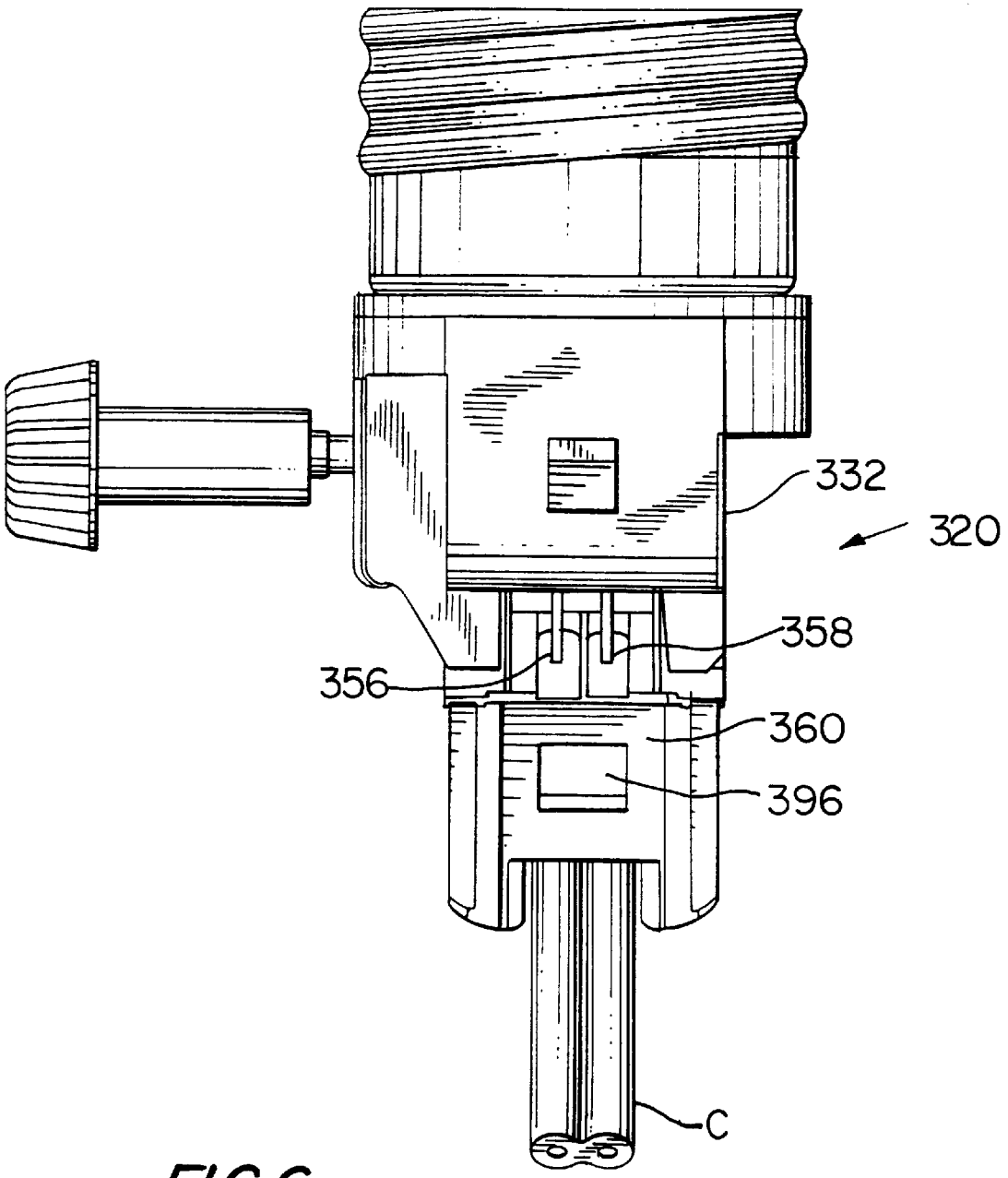
FIG. 6 is a front elevational view of the lamp socket assembly of FIG. 3 with an electrical cord inserted therein.
Figure 7:
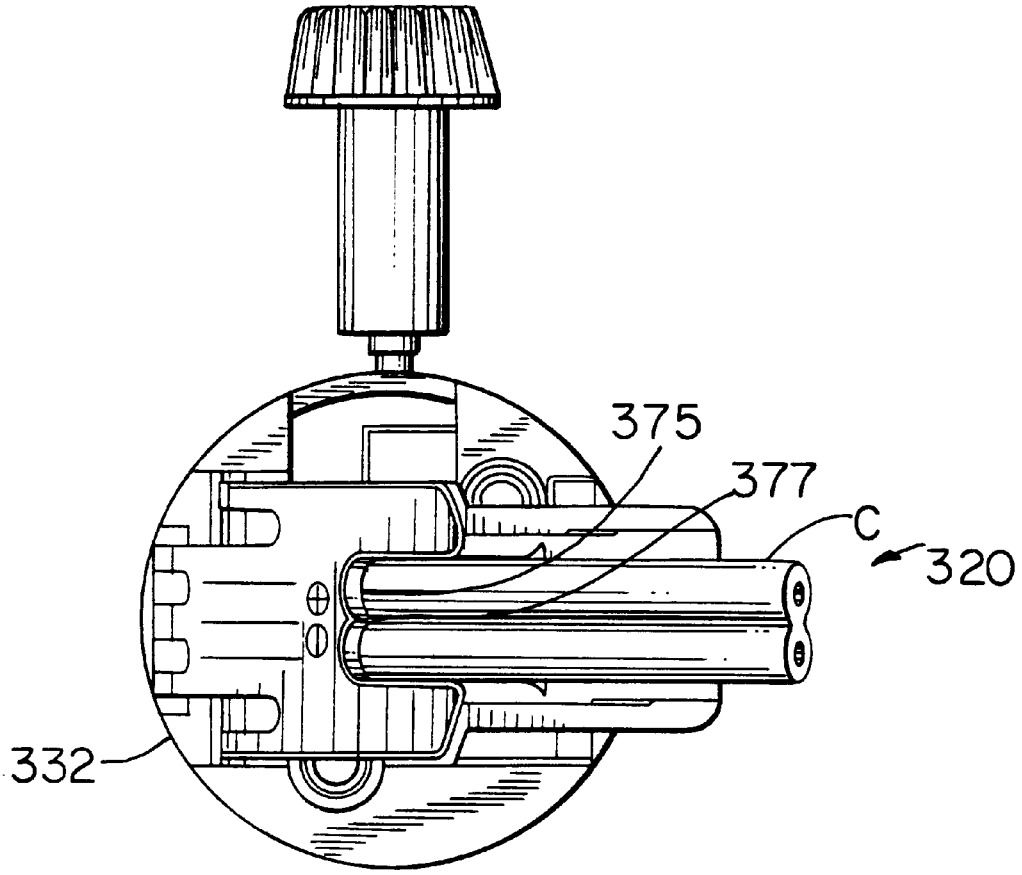
FIG. 7 is a bottom plan view of the lamp socket assembly of FIG. 4 with an electrical cord inserted therein.
Figure 8:
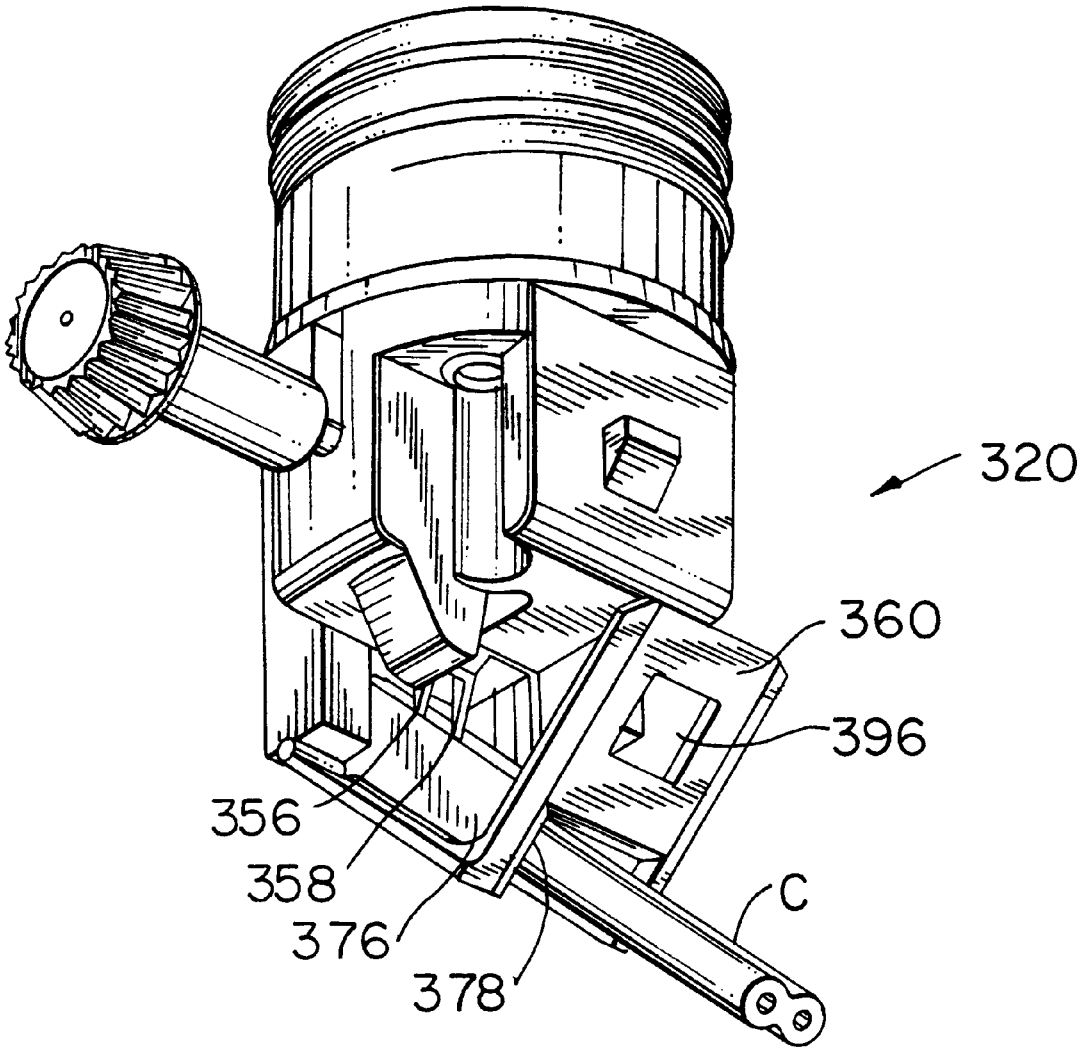
FIG. 8 is a front perspective view of the lamp socket assembly of FIG. 2.
Figure 9:
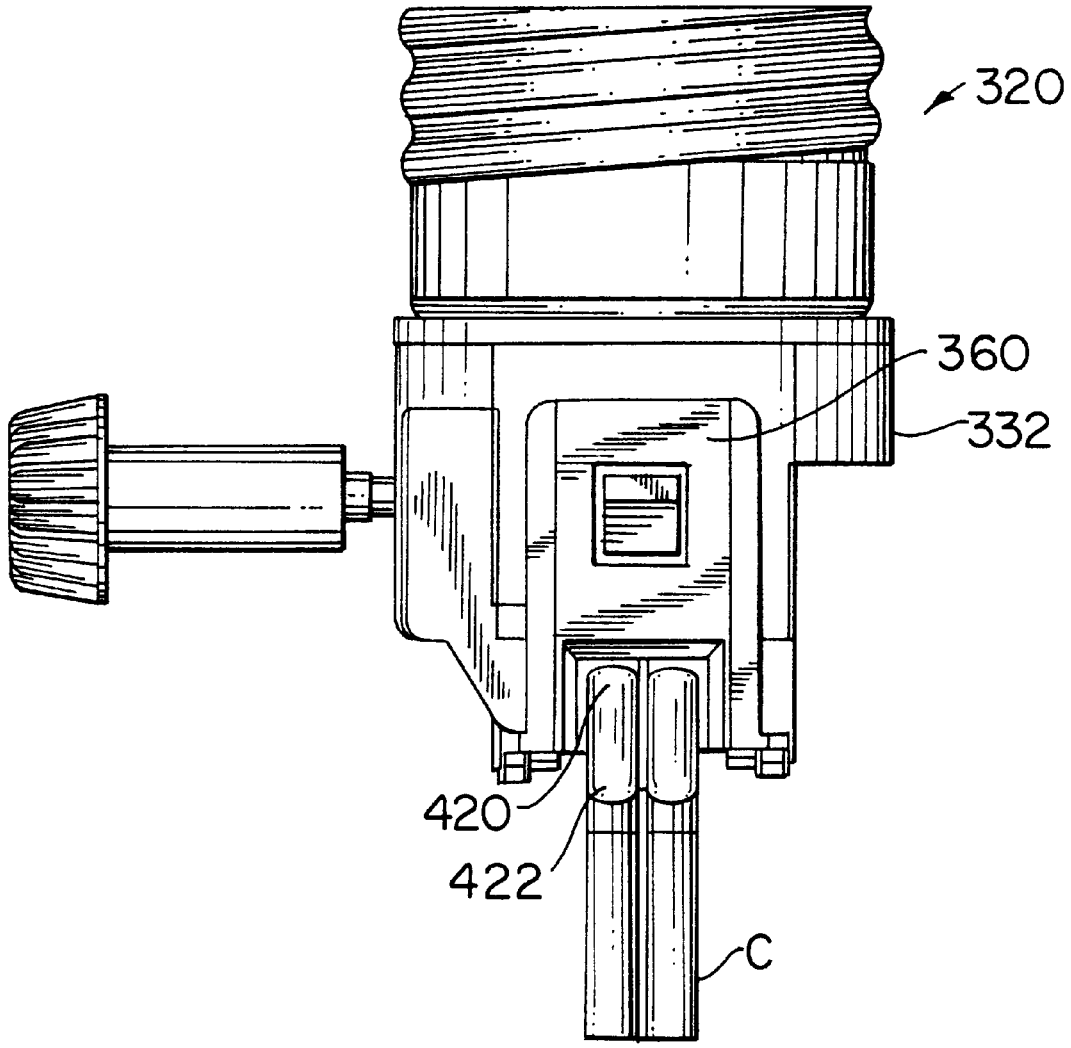
FIG. 9. is a front elevational view of the lamp socket assembly of FIG. 6 with the actuator means closed upon the inserted electrical cord.
Figure 10:
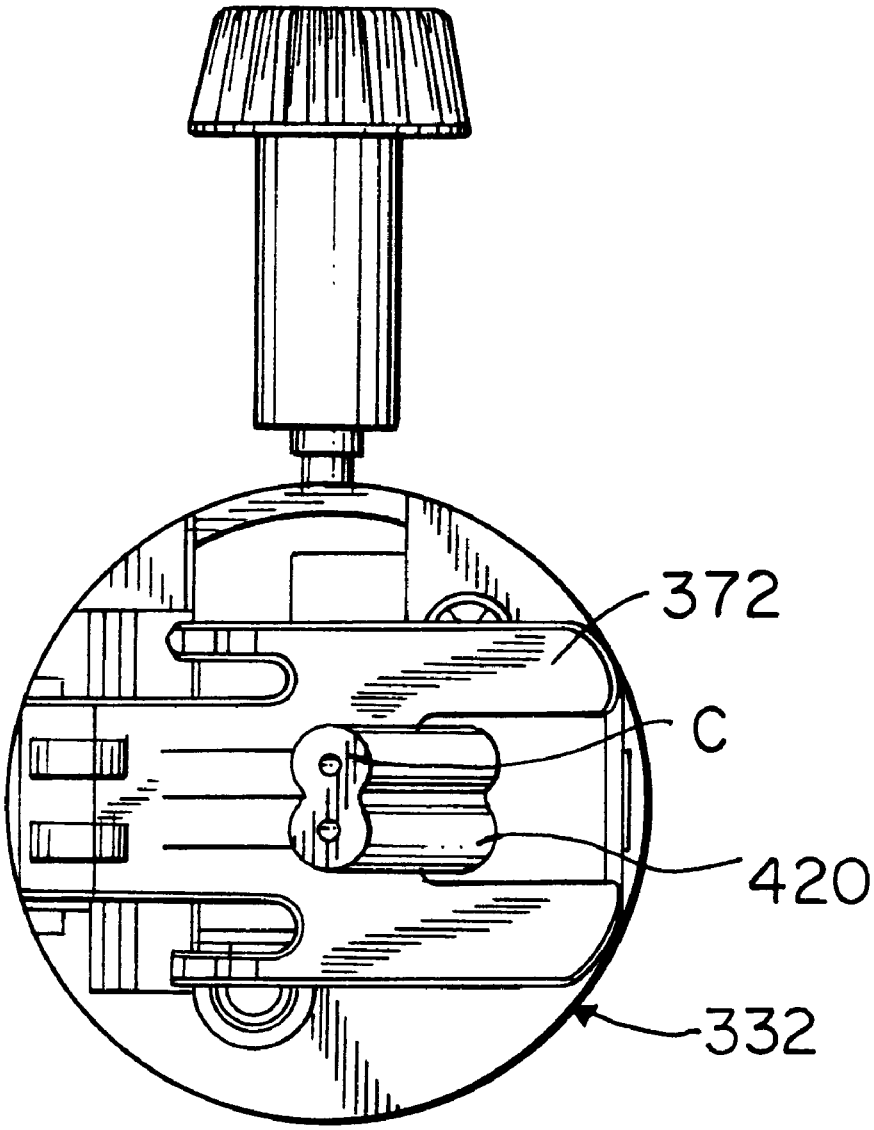
FIG. 10 is a bottom plan view of the lamp socket assembly of FIG. 7 closed upon the inserted electrical cord.

With the activator means 370 in the open position, that is with fingers 386 in the notches 388, as shown in FIGS. 2 and 8, an electrical cord C with a square-cut end is inserted into passageway 378 and advanced until the end of electrical cord C reaches the closed end 382 of the actuator means 370. (See FIGS. 6 and 7.) Now the actuator means 370 is rotated in the counter-clockwise direction (as viewed in FIG. 2) to bring the contacts 356, 358 into engagement with an associated one of the two side-by-side conductors of the electrical cord C. The further movement of the actuator 370 causes the contacts 356, 358 to pierce the insulation about their associated conductors and make contact with the central metallic conductor therein. The actuator means 370 is now locked in place by placing the locking step 362 in the first aperture 396 of locking plate 394 as set out above.

Figure 13:
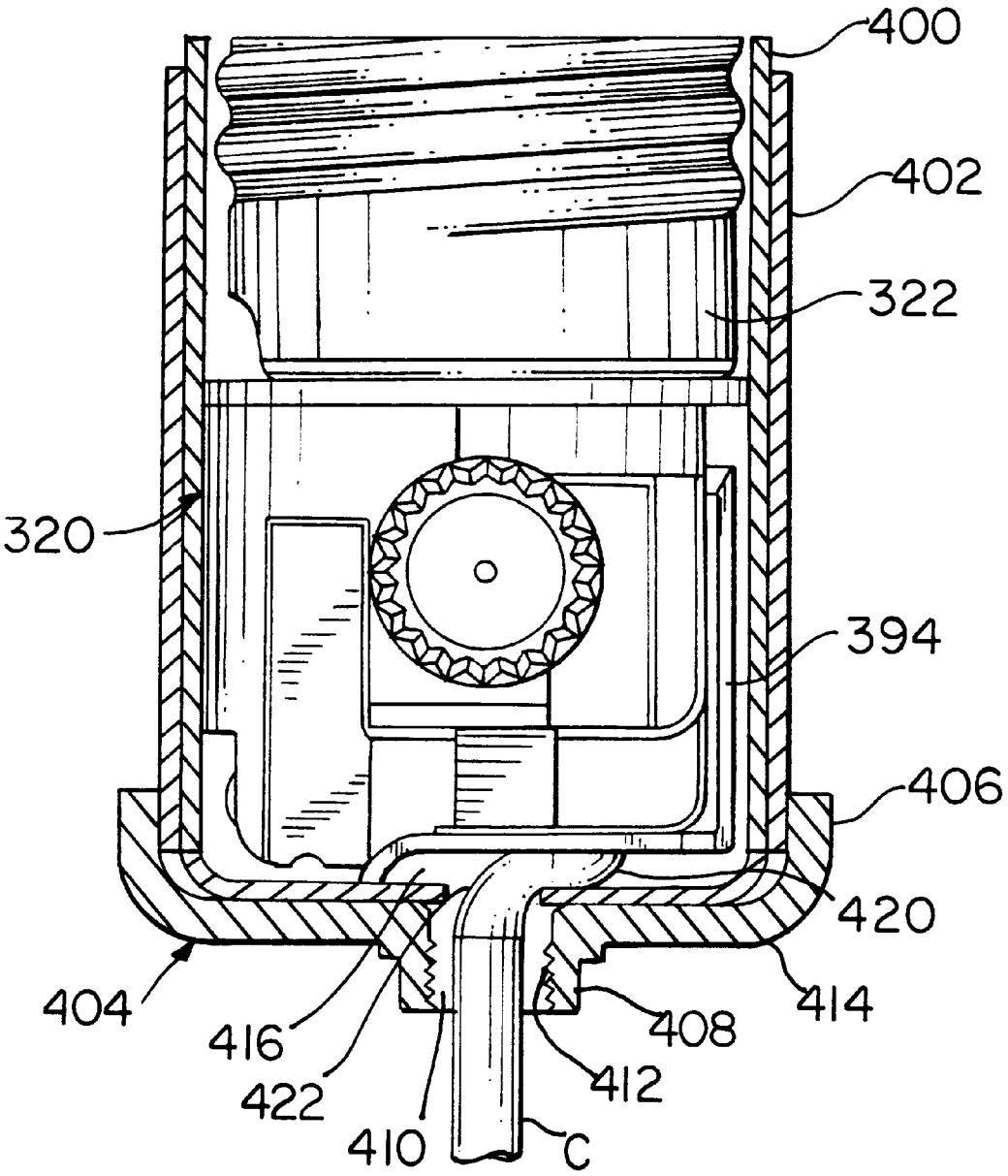
FIG. 13 is a side elevational view, partially in section, of the lamp socket assembly of FIG. 11 surrounded by a shell and cap.

Turning now to FIG. 13 there is shown a lamp socket assembly 320 connected to electrical cord C and within an insulating sleeve 400 of heavy paper molded to the shape of assembly 320. The sleeve 400 extends beyond the screwshell 322 to prevent accidental contact with the screwshell 322. About insulating sleeve 400 is placed a metal shell 402. The end of the body member 332 and the end of the shell 402 are closed by means of a cap 404. Cap 404 has a first circular portion 406 which fits over the end of shell 402. The cap 404 has a series of projections (not shown) on the inner surface of circular portion 406 which mate with recesses (not shown) adjacent the end of shell 402 to hold the shell 402 and cap 404 assembled. A second circular portion 408 has a central aperture 410 which is threaded as at 412. The electrical cord C can exit the assembly 320 through central aperture 410 or can extend through a circular conduit (not shown) threaded on its exterior surface to engage the threads 412 of cap 404 as is often done on lamps (not shown). First circular portion 406 has a diameter greater than second circular portion 408 and the intermediate portion 414 is tapered between first circular portion 406 and second circular portion 408. A space 416 exists between the inner surface of intermediate portion 414 and first end face 334 of body member 332 to permit the electrical cord C to be contoured so as to exit the cap 404 along the central longitudinal axis of the lamp socket assembly 320.

Once the actuator means 370 is in its locked position (see FIGS. 9 to 12) and the contacts 356 and 358 engage their associated conductors of electrical cord D, the electrical cord C is bent upwardly at a first bend (not shown) and extends along the exposed edge 373 of the partial top member 372. Each of the two side-by-side inductors enters an associated one of the two recesses 375 and tooth 377 enters the web between the two conductors of electrical cord C. The electrical cord C is bent along an axis perpendicular to the assembly 320 longitudinal axis, as at the second bend 420, and extends along the top surface of partial top member 372 in space 416 for a short distance. The electrical cord C is bent upwardly, as at bend 422, to align the electrical cord C with the central aperture 410 and the electrical cord C is made to exit the cap 404 as is shown in FIG. 13. The shape of the electrical cord C and its retention against the exposed edge 373 of partial top member 372 is retained by the free end of the electrical cord C being assembled to the contacts 356, 358 and the remainder of electrical cord C exiting aperture 410.

While there have been shown and described and pointed out the fundamental novel features of the invention as applied to the preferred embodiment, as is presently contemplated for carrying them out, it will be understood that various omissions and substitutions and changes of the form and details of the device illustrated and in its operation may be made by those skilled in the art, without departing from the spirit of the invention.

We claim:

1. A lamp socket assembly comprising:

a) a substantially cylindrical screwshell having a substantially closed end, an open end and a wall in which is formed a screw thread between said ends, said screwshell making an electrical connection with the threaded metal base of an electrical lamp placed in said screwshell through said open end and made to threadable engage said screw thread of said screwshell wall;

b) a disk of insulating material having a first surface and a second surface;

c) a body member fabricated of insulating material having a first end surface and a second end surface parallel with one another and spaced apart along a central longitudinal axis of said assembly; said disk positioned between said screwshell and said body member with said first surface of said disk adjacent said substantially closed end of said screwshell and said second surface of said disk adjacent said second end surface of said body member;

d) a substantially U-shaped recess in said first end surface extending across said first end surface perpendicular to said central longitudinal axis and into said body member towards said second end surface; said recess having a width less than said first end surface diameter to provide a shoulder on said first end surface to each side of said recess, said recess having a floor and two vertical walls parallel with said central longitudinal axis;

e) a first conductive member having a first end and a second end;

f) first fastening means holding in assembly said screwshell, said disk, said body member and said second end of said first conductive member;

g) said first conductive member having a first insulation piercing contact at said first end extending into said recess for piercing the insulation and making contact with a first central metallic conductor of an insulated electrical cord having two side-by-side linked insulated electrical conductors;

h) a second conductive member having a third end and a fourth end;

i) a displaceable tongue having a fifth end and a sixth end, said fifth end of said displaceable tongue passing through the non-closed portion of said substantially closed end of said screwshell and an aperture in said disk to engage said fourth end of said second conductive member, said sixth end of said displaceable tongue positioned in said screwshell to engage the contact button at the base of an electrical lamp threadably engaging said screw thread of said screwshell wall;

j) said second conductive member having a second insulation piercing contact at said third end extending into said recess for piercing the insulation and making contact with a second central metallic conductor of an insulated electrical cord having two side-by-side linked insulated electrical conductors;

k) actuator means having a first end and a second end, said actuator means pivotally mounted adjacent said second end to said vertical walls of said recess to permit said actuator means to move said first end of said actuator means towards and away from said floor of said recess;

l) said actuator means having a central passageway extending from adjacent said first end of said actuator means towards said second end of said actuator means to receive an electrical cord therein when said actuator means first end is pivoted away from said floor of said recess and to cause the engagement of each of said two side-by-side linked insulated electrical conductors with the associated first and second insulation piercing contacts and the electrical connection of each of said first and second central metallic conductors with an associated first and second insulation piercing contacts when said actuator means first end is pivoted towards said floor of said recess;

m) said actuator means having a partial top member with an exposed edge and two side members joined so as to form a partial, hollow rectangular structure open adjacent said first end of said actuating means and closed adjacent said second end of said actuating means, the inner surfaces of said partial top member and said two side members defining said central passageway;

n) a front face on said body member extending parallel to said central longitudinal axis and aligned with said recess;

o) a locking step on said front face having a locking face perpendicular to said central longitudinal axis;

p) a locking plate coupled to said first end of said actuating means and movable therewith and overlying said locking step when said actuator means moves said electrical cord towards said recess floor;

q) a first aperture in said locking plate to receive said locking step when said actuator means is adjacent said recess floor to prevent the movement of said actuator means away from said recess floor; and r) said exposed edge of said partial top member engaging said electrical cord to provide strain relief for said electrical cord when extended along said exposed edge.

2. A lamp socket assembly, as defined in claim 1, wherein said exposed edge of said partial top member is defined by at least two recesses, each recess arranged to receive therein one of the insulated conductors of said insulated electrical cord having two side-by-side linked electrical conductors and provide strain relief.

3. A lamp socket assembly, as defined in claim 2, wherein said exposed edge of said partial top member further comprises a tooth for engagement of a web between said two side-by-side linked electrical conductors to provided further strain relief.

4. A lamp socket assembly, as defined in claim 2, wherein each of said at least two recesses has a tapered edge to present a line of contact for each of said two side-by-side linked electrical conductors.

5. A lamp socket assembly, as defined in claim 3, wherein each of said at least two recesses has a tapered edge to present a line of contact for each of said two side-by-side linked electrical conductors.

6. A lamp socket assembly, as defined in claim 1, further comprising:

a) an open slot in said locking plate aligned with said central passageway to permit electrical cords to be inserted into said central passageway.

7. A lamp socket assembly, as defined in claim 1, wherein said locking step comprises:

a) a first outwardly inclined surface engagable by said locking plate to force a portion of said locking plate away from said front face; and b) a locking surface to engage a wall defining said first aperture when said locking step enters said first aperture and returns to an initial condition.

8. A lamp socket assembly, as defined by claim 1, further comprising:

a) two assembly tabs, one for each of said two vertical walls, extending from said top member adjacent said actuator means second end; and b) two assembly recesses, one for each of said two assembly tabs, whereby when each of said two assembly tabs is in a corresponding one of said two assembly recesses, said actuator means cannot be removed from said body member by rotating said actuator means first end away from said recess floor.

9. A lamp socket assembly, as defined in claim 8, further comprising:

a) two deflector shoulders, one for each of said two vertical walls to deflect said assembly tabs out of respective assembly recesses when said actuator means is adjacent to the floor of said recess.

10. A lamp socket assembly, as defined in claim 1, further comprising:

a) a cylindrical shell to fit about the outer surface of said lamp socket assembly from said screwshell to said body member first end surface, said shell having an interior surface and an exterior surface, a first open end and a second open end, said first open end adjacent said screwshell open end and said second open end adjacent said body member first end; and b) a cap having an interior surface and an exterior surface, said cap having a circular open first end dimensioned to fit over said exterior surface of said shell with the interior surface of said cap in contact with the exterior surface of said shell, said cap having a central aperture in a second, substantially closed end of said cap to receive there through an electrical cord extending in parallel with said central longitudinal axis away from said first end surface of said body member, and said cap having a tapered portion between said open first end and said second, substantially closed end, the interior surface of said cap engaging the electrical cord extending in parallel with said central longitudinal axis away from said first end surface of said body member and forcing such cord against said expose edge of said partial top member.

11. A lamp socket assembly, as defined in claim 10, wherein said exposed edge of said partial top member is defined by at least two recesses, each recess arranged to receive therein one of the insulated conductors of said insulated electrical cord having two side-by-side linked electrical conductors and provide strain relief.

12. A lamp socket assembly, as defined in claim 11, wherein said exposed edge of said partial top member further comprises a tooth for engagement of a web between said two side-by-side linked electrical conductors to provide further strain relief.

13. A lamp socket assembly, as defined in claim 11, wherein each of said at least two recesses has a tapered edge to present a line of contact for each of said two side-by-side linked conductors.

14. A lamp socket assembly, as defined in claim 12, wherein each of said at least two recesses has a tapered edge to present a line of contact for each of said two side-by-side linked conductors.

* * * * *